US006356019B1

(12) United States Patent
Hutcherson et al.

(10) Patent No.: US 6,356,019 B1
(45) Date of Patent: Mar. 12, 2002

(54) FLUORESCENT LAMP AND METHODS FOR MAKING ELECTRODE ASSEMBLIES FOR FLUORESCENT LAMPS

(75) Inventors: R. Kenneth Hutcherson, Beverly; James A. Gotay, Lowell; Joseph V. Lima; Louise D. Cleary, both of Salem; Philip E. Moskowitz, Georgetown, all of MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/337,941

(22) Filed: Jun. 22, 1999

(51) Int. Cl.[7] ..... H01J 61/04
(52) U.S. Cl. ..... 313/631; 313/491; 313/632
(58) Field of Search ..... 313/631, 491, 313/492, 632, 346 R, 326

(56) References Cited

U.S. PATENT DOCUMENTS 5,278,474 A * 1/1994 Nieda ..... 313/631
5,982,088 A * 11/1999 Hamada et al. ..... 313/631 X

* cited by examiner

*Primary Examiner*—Ashok Patel
(74) *Attorney, Agent, or Firm*—Carlo S. Bessone

(57) ABSTRACT

A fluorescent lamp comprises a glass tubular body defining a discharge space, and first and second electrode assemblies mounted in the discharge space in opposition to each other, each of the electrode assemblies comprising a first electrode and a second electrode. Each of the first electrodes comprises a metal lead wire with an electron-emitting material disposed on a free end thereof, and each of the second electrodes comprises a cup-shaped tube coaxially surrounding one of the first electrodes and the electron-emitting material disposed on the first electrode. The second electrode tube and the electron emitting material therein form an annular gap therebetween.

12 Claims, 3 Drawing Sheets

FLUORESCENT LAMP AND METHODS FOR MAKING ELECTRODE ASSEMBLIES FOR FLUORESCENT LAMPS

BACKGROUND OF THE INVENTION

1. Field of the Invention

The invention relates to fluorescent lamps, and is directed more particularly to improvements in specialty lamps, such as small diameter low power fluorescent lamps and to methods for making electrode assemblies for such lamps.

2. Description of the Prior Art

It is known to provide a fluorescent lamp with a glass tubular body defining a discharge space, and a pair of electrode assemblies disposed in the discharge space in opposed relation to each other. Each of the electrode assemblies includes an arc discharge electrode and a glow discharge electrode disposed adjacent to each other. An electron-emitting substance is incorporated in the arc discharge electrode and is, in operation, vaporized and emitted from the arc discharge electrode and captured by the glow discharge electrode.

It is further known to provide an arc discharge electrode which comprises a sintered body containing therein an electron radiating substance. Such is disclosed, for example, in U.S. Pat. No. 5,304,893, issued Apr. 19, 1994, to Y. Nieda.

Many current small diameter fluorescent lamps are of the type described above and are provided with electrode assemblies as described above. Such lamps require either a high operating voltage or, in some cases, separate power to heat the electrodes. There is a need for a small diameter fluorescent lamp in which the electrodes operate thermionically, at low voltage and without need of external heater power. There is an attendant need for a method for making electrode assemblies for such lamps.

Current cold cathode, small diameter (less than 6 mm inside diameter) and low pressure (less than 100 torr) lamps exhibit limited life because of changes in lamp color, rapidly followed by cracking of the lamp envelope proximate to the electrodes. It has been found that lamp color changes are caused by "gas trapping". That is, gas ions which drift near the glow discharge electrodes are accelerated in large glow discharge electrode fields and slam into the glow discharge electrode surface, sometimes leaving gas particles trapped below the surface of the glow discharge electrode. A reduction in gas atoms in the lamp shifts the discharge electron energy distribution to higher energies. Higher energy electrons excite higher energy levels within the gas atoms, causing a change in the emission spectrum, that is, a color shift. Sputtering, which necessarily accompanies gas trapping, knocks metal atoms from the electrode and sputter remnants drift to, and deposit on, the inside of the lamp glass envelope. The discharge attaches to the metallic coating, creating large heat flux to the glass surface. Cooling in the glow discharge electrode region causes mechanical stresses in the lamp glass envelope resulting from the differences in thermal expansion properties between the glass and the sputtered metal. This differential thermal expansion causes the lamp envelope to crack.

There is therefore a need for a small diameter low pressure lamp in which the electrode assemblies are not subject to gas trapping and which exhibit a substantially longer life than current standard electrodes. There is further a need for a method for making electrode assemblies for such lamps.

SUMMARY OF THE INVENTION

An object of the invention is, therefore, to provide a small diameter low pressure fluorescent lamp having electrode assemblies which operate at low voltage and without the need of external heater power.

A further object of the invention is to provide a method for making electrode assemblies for such a small diameter low pressure lamp.

A still further object of the invention is to provide a small diameter low pressure fluorescent lamp having electrode assemblies which are not subject to gas trapping, permitting the lamp to exhibit a longer working life.

A still further object of the invention is to provide a method for making electrode assemblies for such a small diameter low pressure lamp.

With the above and other objects in view, as will hereinafter appear, a feature of the present invention is the provision of a fluorescent lamp comprising a glass tubular body defining a discharge space, first and second electrode assemblies mounted in the discharge space in opposition to each other, each of the electrode assemblies comprising a first electrode and a second electrode. Each of the first electrodes comprises a metal lead wire with an electron-emitting material disposed on a free end thereof. Each of the second electrodes comprises a cup-shaped body coaxially surrounding one of the first electrodes and the electron-emitting material disposed on the first electrode, the second electrode cup-shaped body and the electron emitting material therein forming an annular gap therebetween.

In accordance with a further feature of the invention, there is provided a method for making an electrode assembly for small diameter low pressure fluorescent lamps, the method comprising the steps of providing a metal lead wire having a free end, dipping the wire free end into liquid solvent in which an emitter material is disposed, crimping the wire in a metal tube with the wire free end and emitter material thereon recessed inside the tube, vacuum baking the tube, wire and emitter on the wire, and sealing the wire in a glass tubular body portion of the fluorescent lamp.

In accordance with a still further feature of the invention, there is provided a method for making an electrode assembly for small diameter low pressure fluorescent lamps, the method comprising the steps of providing a metal lead wire having a free end, sealing the lead wire in a high temperature glass electrode, the electrode comprising a cup-shaped body, with the lead wire disposed substantially centrally, widthwise, of the cup-shaped body, and dipping the wire free end into a liquid solvent in which an emitter material is dispersed.

The above and other features of the invention, including various novel details of construction and combinations of parts and method steps, will now be more particularly described with reference to the accompanying drawings and pointed out in the claims. It will be understood that the particular devices and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
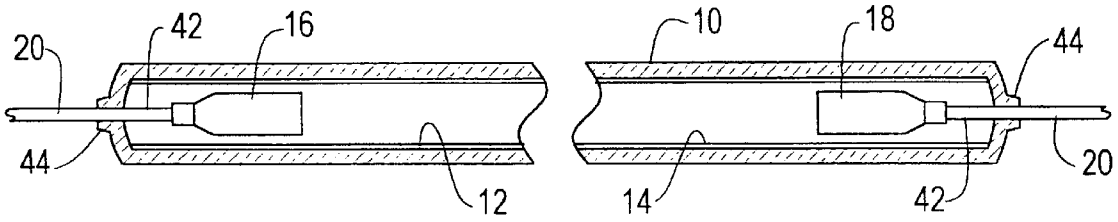
FIG. 1 is a diagrammatic sectional view of one form of fluorescent lamp illustrative of an embodiment of the invention.

Referring to FIG. 1, it will be seen that an illustrative fluorescent lamp includes a glass tubular body 10 having an inner surface 12 coated with a fluorescent material 14. Electrode assemblies 16, 18 are mounted in the tubular body 10 and are positioned at opposite ends of the tubular body. Lead wires 20 extend through the opposite ends of the tubular body 10. A gas, such as neon, is sealed in the glass tubular body 10.

Figure 2:
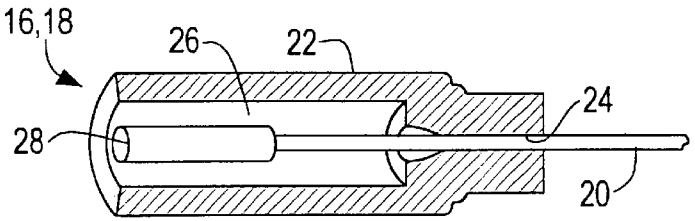
FIG. 2 PRIOR ART
FIG. 2 is a diagrammatic sectional view of a prior art electrode assembly used in lamps of the type shown in FIG. 1.

Referring to FIG. 2, it will be seen that it is known for the electrode assemblies 16, 18 each to include the lead wire 20, which constitutes in part a first electrode, and a generally cup-shaped electrode 22, typically of sintered metal, such as nickel and tungsten, which constitutes a second electrode. To form the second electrode 22, a mixture of nickel and tungsten is press-molded or compacted into the cup shape by a mold and then sintered. A through hole 24 is formed axially through the closed end portion of the cup-shaped electrode 22. After the first electrode lead wire 20, is passed through the through hole 24, the closed end portion of the electrode is pressed radially inwardly, such that the lead wire is held within the cup-shaped second electrode 22.

The first electrode 26 comprises the lead wire 20 and a sintered metal body 28 supported by the lead wire. The body 28 may be formed of barium mixed with tungsten powder. The powder mixture is press-molded or compacted into a cylindrical shape with an end portion of the lead wire 20 embedded therein. The cylindrical body 28 is then sintered to complete the arc discharge electrode 26. It is known to further include in the powder mixture cesium and/or lanthanum boride.

Lamps provided with electrodes of the type shown in FIG. 2 exhibit limited life because an arc between the first and second electrodes attaches near the end of the glow discharge cup.

Figure 3:
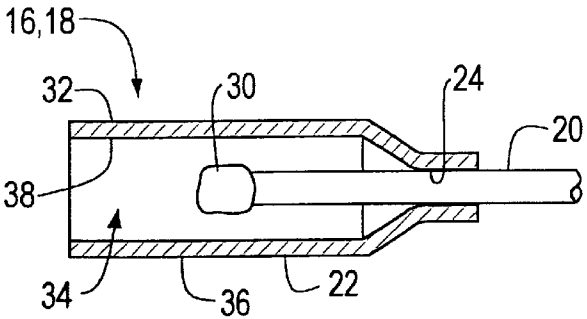
FIG. 3 is a diagrammatic sectional view of an improved electrode assembly for use in the lamp of FIG. 1.

Referring to FIG. 3, it will be seen that an illustrative improved lamp includes electrode assemblies wherein there is provided a first electrode including the lead wire 20 and on a free end of the lead wire 20 a body 30 of emitter material, such as barium zirconate. The emitter material body 30 is placed on the lead wire 20 by dipping the end of the lead wire 20 into a liquid solvent in which the emitter material is dispersed. A metal tube 32 is crimped onto the lead wire 20 to form the cup-shaped second electrode 22, such that the body 30 of emitter material is disposed well within the metal tube 32.

After crimping of the emitter-tipped lead wire 20 in the metal tube 32, the electrode assembly 16, 18 is vacuum baked at pressures of less than $10^{-5}$ Torr and a peak temperature of about 800° C. The electrode assemblies 16, 18 are then sealed in the lamp glass tubular body 10, which may be filled with a discharge gas, such as a mixture of argon, neon, and/or mercury.

The electrode tube 32 and the body of emitter material 30 form an annular gap therebetween. The length and diameter of the tube 32 are selected to encourage initiation of a glow discharge in the metal tube in a hollow 34 in front of (to the left of, as shown in FIG. 3) the emitter material body 30 prior to thermionic operation. The electrode 22 minimizes sputtering loses upon lamp ignition.

It is believed that the hollow tube 32 in front of the emitter body 30 allows for more efficient ionization, causing the discharge to be initiated inside the tube 32, rather than on the outside thereof, the latter leading to faster end darkening and shorter lamp life. Larger hollow length to diameter ratios reduce the transport rate of emitter body 30 out of the hollow 34 and onto lamp walls 10. The longer the emitter remains in the hollow 34, the longer the electrode work function remains low, and hence, the longer the electrode life. Larger hollow length to diameter ratios further serve to decrease the emitter cooling rate due to gas thermal conduction and radiative cooling. The emitter thus can operate thermionically at lower currents, and with lower power requirements.

It has been found that higher electron densities are produced inside the electrode tube 32 within a certain range of tube inside diameters and lengths. To obtain high electron densities, ionization events must occur in the tube 32 so as to produce electrons having sufficient energy for further ionization. This means that electrons that leave the tube inner surface 38 must have greater than the gas ionization energy when they reach the opposing tube wall. This condition puts an upper limit on the cup inside diameter. An electron which leaves the tube inner surface 38 must lose some energy before reaching the opposing tube wall, otherwise, the electron crashes into the opposing tube wall, its energy no longer available for ionization. This means that the electron must undergo at least one (preferably several) elastic collision with a neutral gas atom on its travel from tube wall to tube wall. This condition puts a lower limit on the cup inside diameter. Finally, to produce enhanced ionization, hence larger electron density, electrons need to stay in the tube 32, rather than escape through the open end. The efficiency of trapping electrons within the hollow tube 32 is given roughly by the ratio of the internal cathode surface area to total surface area (including any openings). It has been found that to coax the lamp discharge inside the hollow tube 32 and initiate thermionic emission, hence extended lamp life, the hollow glow discharge electrode tube, for use in the body 10 having neon gas therein, must be provided with a L/D ratio of >2.0–2.5, that is, the length L (FIG. 4) must be more than 2 to 2.5 times greater than the inside diameter D.

Figure 4:
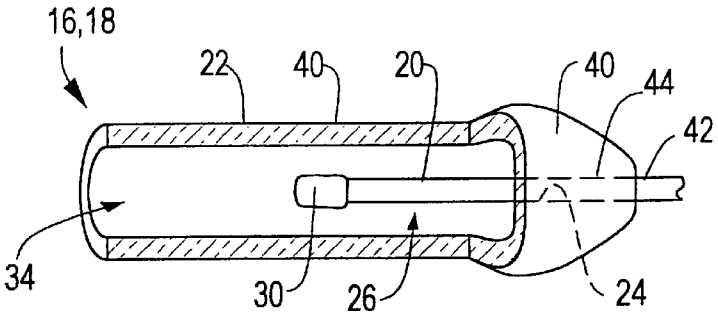
FIG. 4 is a side elevational view, partly in section, of an alternative improved electrode assembly for use in the lamp of FIG. 1.

Referring to FIG. 4, it will be seen that a similar construction of lamp may be provided with the second electrode comprising a glass tube 40 of high temperature glass sealed onto the lead wire 20. The glass tube 40 is provided with an overall length of about 10 mm, an outside diameter of about 2.5 mm, and an inside diameter of about 1.5 mm. The lead wire 20 preferably is of molybdenum and of about 0.02 inch diameter. The glass/metal seal is effected in a flowing nitrogen environment with a natural gas+oxygen flame.

In manufacture, the lead wire 20 is sealed into the high temperature glass tube 40. The end of the lead wire 20 within the glass tube 40 is then dipped into an emitter material, such as a $BaZro_3$/Nitrocellulose binder slurry, coating the end of the lead wire 20 with emitter material. To remove the binder and release residual stress in the glass tube 40, the electrode assembly is vacuum baked at about 500° C. for about 30 minutes (1 hour ramp time) at a pressure of $<10^{-5}$ Torr. The electrode assembly is then sealed into an end of the fluorescent lamp glass tubular body 10 (FIG. 1), leaving a short length 42 of lead wire 20 exposed between the glass tube 40 and a lamp seal 44.

In operation, the glass cup-shaped tube 40 forces discharge attachment to the central lead wire 20 and confines sputter remnants to inside the hollow 34. The effect is that the electrode assembly has less than one-third the surface area for gas trapping, compared with a standard nickel (Ni) cup electrode assembly. Once the available surface is saturated with trapped gas atoms, further gas atom bombardment is as likely to release trapped atoms as it is to trap additional gas atoms. Thus, gas trapping essentially stops. Further, sputter remnants are inhibited from reaching the lamp glass envelope 10, thus eliminating arc rooting, differential thermal expansion, and attendant lamp cracking.

Figure 5:
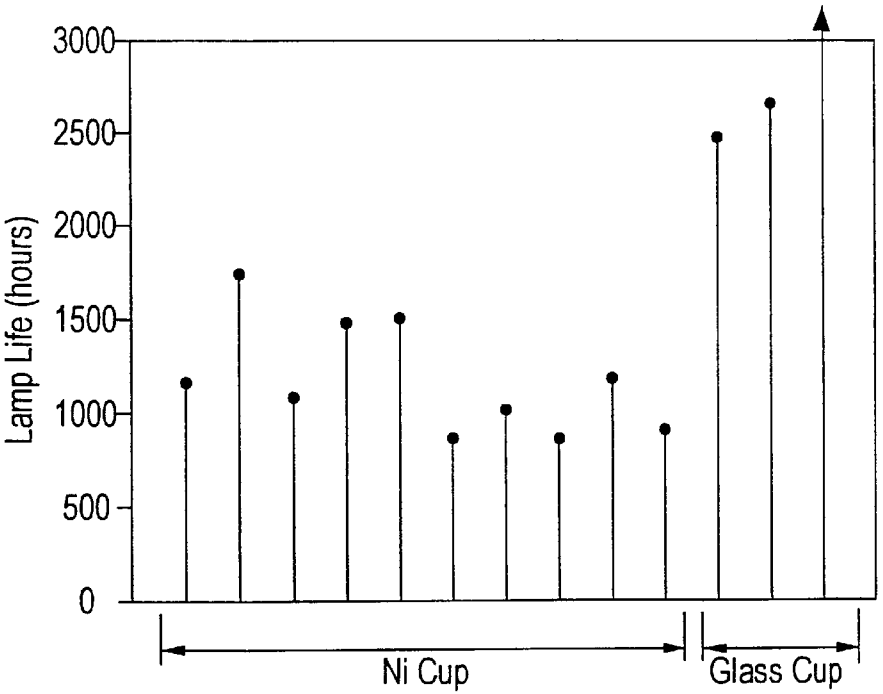
FIG. 5 is a chart depicting comparison of lamp lives for lamps with prior art electrode assemblies and lamps with electrode assemblies as shown in FIG. 4.
Figure 10:
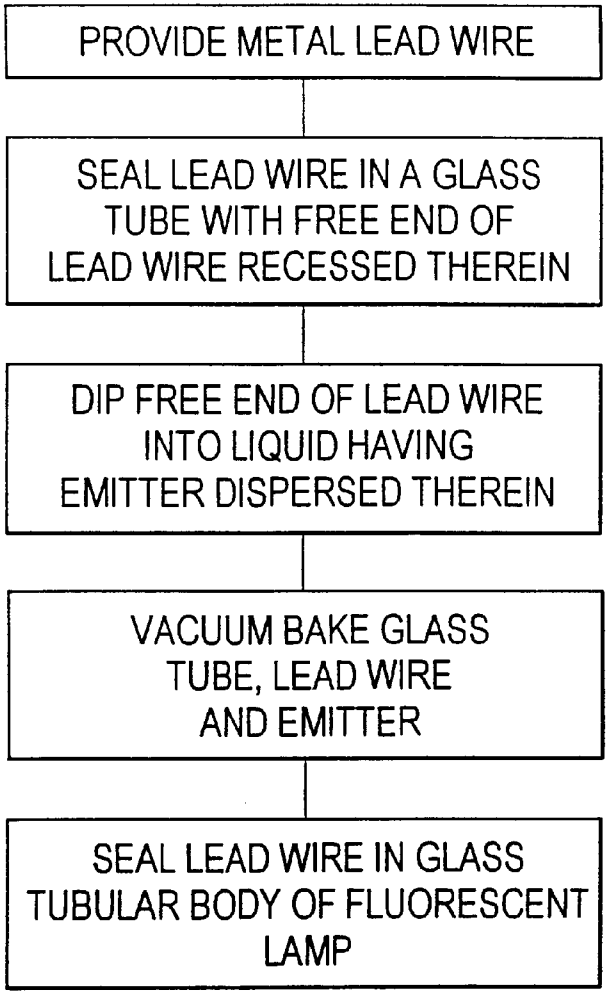
FIG. 10 is a flow chart illustrative of a method for making the electrode assembly of FIG. 4.
Figure 9:
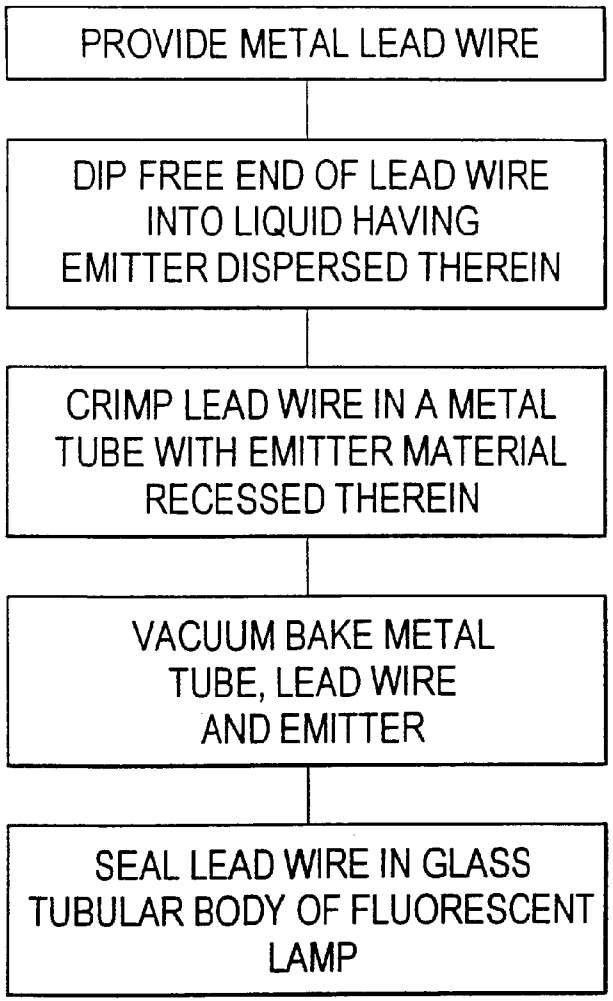
FIG. 9 is a flow chart illustrative of a method for making the electrode assembly of FIG. 3.

Referring to FIG. 5, it will be seen that a comparison of lamp life test results between ten standard Ni electrodes and three glass electrodes produced about 1200 hours average life for the Ni electrodes and a minimum of 2500 hours life for the glass electrodes.

In addition, it has been found that the above-described electrode can operate thermionically at lower currents than typical thermionic electrodes. The glass cup does not conduct heat and, hence, can be thermionic at lower temperature, thereby requiring lower currents.

Figure 6:
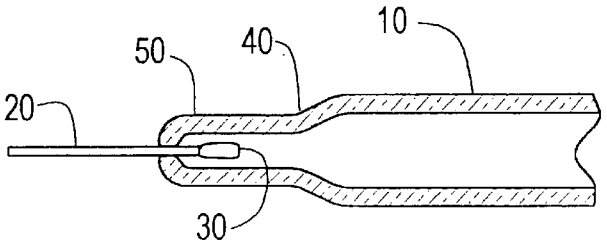
FIGS. 6–8 are diagrammatic sectional views of alternative electrode assemblies, similar to that shown in FIG. 4.
Figure 7:
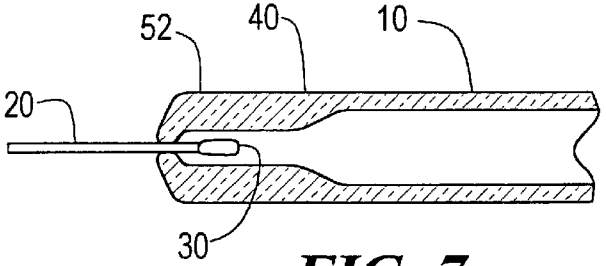

In FIGS. 6 and 7, there are shown alternative embodiments in which the high temperature glass tube 40 and the fluorescent lamp glass tubular body 10, are one and the same, that is, the ends of the lamp glass tubular body 10 act as the glass discharge tube 40 of an electrode assembly. The lamp glass tubular body 10 can be formed to provide a small diameter cup 50, as shown in FIG. 7, or alternatively, a cup 52 having a small inside diameter and large outside diameter for additional strength.

Figure 8:
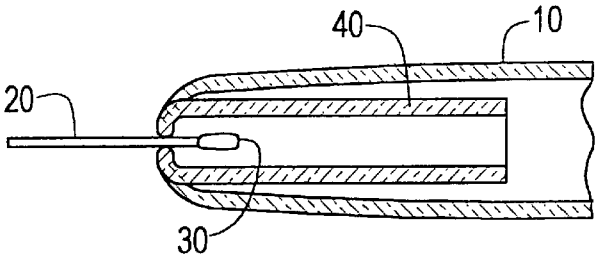

In FIG. 8, there is shown a further alternative embodiment in which the glass tube 40 is formed as a discrete member but is fused with the lamp glass tubular body 10.

It is to be understood that the present invention is by no means limited to the particular constructions and method steps herein disclosed and/or shown in the drawings, but also comprises any modifications or equivalents within the scope of the claims.

What is claimed is:

1. A fluorescent lamp comprising:

a glass tubular body defining a discharge space;

first and second electrode assemblies mounted in said discharge space in opposition to each other, each of said electrode assemblies comprising a first electrode and a second electrode;

each of said first electrodes comprising a metal lead wire with an electron-emitting material disposed on a free end thereof; and each of said second electrodes comprising a cup-shaped tube coaxially surrounding one of said lead wires and the electron-emitting material disposed on said lead wire, said cup-shaped tube and said electron-emitting material therein forming an annular gap therebetween, and said electron-emitting material being spaced from an open end of said cup-shaped tube, said cup-shaped tube is provided with a length of about 2.0–2.5 times an inside diameter thereof.

2. The lamp in accordance with claim 1 wherein said electron-emitting material is disposed about midway between said open end of said tube and a closed end of said tube.

3. The lamp in accordance with claim 1 wherein said electron-emitting material comprises a barium-containing emitter material.

4. The lamp in accordance with claim 3 wherein said barium-containing material comprises barium zirconate ($BaZrO_3$).

5. The lamp in accordance with claim 1 wherein said lead wire is of molybdenum (Mo) and is about 0.020 inch in diameter.

6. The lamp in accordance with claim 1 wherein said second electrodes comprise metal tubes crimped onto said lead wires.

7. A fluorescent lamp comprising:

a glass tubular body defining a discharge space;

first and second electrode assemblies mounted in said discharge space in opposition to each other, each of said electrode assemblies comprising a first electrode and a second electrode;

each of said first electrodes comprising a metal lead wire with an electron-emitting material disposed on a free end thereof; and each of said second electrodes comprising a cup-shaped tube coaxially surrounding one of said lead wires and the electron-emitting material disposed on said lead wire, said cup-shaped tube and said electron-emitting material therein forming an annular gap therebetween, and said electron-emitting material being spaced from an open end of said cup-shaped tube, said cup-shaped tubes each is of a high temperature glass sealed onto said lead wire.

8. The lamp in accordance with claim 7 wherein each of said glass cup-shaped tubes is provided with an overall cup length of about 10 mm, and said free end of said lead wire is disposed about 5 mm from a closed end of said glass tube.

9. The lamp in accordance with claim 8 wherein each of said cup-shaped tubes is provided with an outside diameter of about 2.5 mm.

10. The lamp in accordance with claim 7 wherein said lead wires are each sealed into said glass tubular body, and closed ends of said cup-shaped tubes are spaced from an end of said tubular body by about 1 mm.

11. The lamp in accordance with claim 7 wherein each of said cup-shaped tubes comprises a portion of said glass tubular body.

12. The lamp in accordance with claim 7 wherein each of said cup-shaped tubes is fused into said glass tubular body.

* * * * *